US009248482B2

(12) United States Patent
Passoni et al.

(10) Patent No.: US 9,248,482 B2
(45) Date of Patent: Feb. 2, 2016

(54) MAGNESIUM ROLL MILL

(75) Inventors: Roberto Passoni, Riverside, CA (US); Christopher A. Romanowski, Lake Arrowhead, CA (US)

(73) Assignee: Fata Hunter, Inc., Riverside, CA (US)

( * ) Notice: Subject to any disclaimer, the term of this patent is extended or adjusted under 35 U.S.C. 154(b) by 333 days.

(21) Appl. No.: 13/415,746

(22) Filed: Mar. 8, 2012

(65) Prior Publication Data

US 2012/0227455 A1 Sep. 13, 2012

Related U.S. Application Data

(60) Provisional application No. 61/451,961, filed on Mar. 11, 2011.

(51) Int. Cl.

| | |
|---|---|
| ***B21B 3/00*** | (2006.01) |
| ***B21B 1/34*** | (2006.01) |
| ***C21D 9/68*** | (2006.01) |
| ***B21C 49/00*** | (2006.01) |
| *B21B 35/04* | (2006.01) |
| *B21B 45/00* | (2006.01) |
| *B21B 15/00* | (2006.01) |

(Continued)

(52) U.S. Cl.

CPC ... *B21B 3/00* (2013.01); *B21B 1/34* (2013.01); *B21C 49/00* (2013.01); *C21D 9/68* (2013.01); *B21B 1/36* (2013.01); *B21B 35/04* (2013.01); *B21B 45/004* (2013.01); *B21B 2015/0057* (2013.01); *B21B 2015/0064* (2013.01); *B21B 2027/086* (2013.01); *B21B 2265/24* (2013.01)

(58) Field of Classification Search

CPC ..... B21B 1/14; B21B 1/32; B21B 1/34; B21B 1/36; B21B 3/00; B21B 34/04; B21B 45/004; B21B 2015/0057; B21B 2015/0064; B21B 2265/24; B21C 49/00; C21D 9/68

USPC ..... 72/128, 200

See application file for complete search history.

(56) References Cited

U.S. PATENT DOCUMENTS 2,675,720 A * 4/1954 Ferm ..... 72/148
3,162,069 A * 12/1964 McLay et al. ..... 72/205

(Continued)

FOREIGN PATENT DOCUMENTS

| | | |
|---|---|---|
| CA | 2 781 504 | 6/2011 |
| CN | 101168167 A | 4/2008 |

(Continued)

OTHER PUBLICATIONS

International Search Report and Written Opinion for International Application No. PCT/US2012/028608; date of mailed Jun. 20, 2012; 7 pages.

(Continued)

*Primary Examiner* — Teresa M Ekiert

(74) *Attorney, Agent, or Firm* — Christie, Parker & Hale, LLP

(57) ABSTRACT

A magnesium hot rolling mill system including a rolling mill having at least two work rolls for rolling of magnesium sheet or plate, a hot coiler positioned on either side of the rolling mill for heating and maintaining a desired temperature of the magnesium sheet or plate, active thermal roller tables, a mill drive system for independently driving the work rolls for asymmetrical rolling of the magnesium sheet and a warm coil loading and payoff station.

20 Claims, 10 Drawing Sheets

(51) Int. Cl.

| | |
|---|---|
| *B21B 27/08* | (2006.01) |
| *B21B 1/36* | (2006.01) |

(56) References Cited

U.S. PATENT DOCUMENTS

| | | | | |
|---|---|---|---|---|
| 4,032,365 | A * | 6/1977 | Bricmont | 72/364 |
| 4,468,262 | A | 8/1984 | Kaneda et al. | |
| 5,042,281 | A * | 8/1991 | Metcalfe | 72/200 |
| 5,269,166 | A | 12/1993 | Thomas | |
| 5,755,128 | A * | 5/1998 | Tippins et al. | 72/202 |
| 6,089,067 | A * | 7/2000 | Yoshioka et al. | 72/202 |
| 7,666,351 | B2 | 2/2010 | Nshikawa et al. | |
| 2004/0007295 | A1 | 1/2004 | Lorentzen et al. | |
| 2010/0326161 | A1 * | 12/2010 | Mimura et al. | 72/202 |
| 2011/0067474 | A1 | 3/2011 | Tazoe et al. | |
| 2011/0100083 | A1 | 5/2011 | Tazoe et al. | |

FOREIGN PATENT DOCUMENTS

| | | | |
|---|---|---|---|
| CN | 101821024 | A | 9/2010 |
| EP | 2 213 387 | A1 | 8/2010 |
| JP | 63040603 | A * | 2/1988 |
| JP | 63188408 | A * | 8/1988 |
| JP | 2003-53415 | | 2/2003 |

OTHER PUBLICATIONS

Office action for parallel Canadian Patent Application No. 2,827,867 citing reference above (CA 2 781 504 to Mori et al.), date issued Jul. 29, 2014, 2 pages.

Communication with Supplementary European Search Report for Application No. 12757438.2; date of mailing May 15, 2015; 6 pages.

First Office action and Search Report issued in parallel Chinese Patent Application 201280012874.8 on Jun. 3, 2015 (6 pages), with English translations (9 pages).

* cited by examiner

MAGNESIUM ROLL MILL

CROSS-REFERENCE TO RELATED APPLICATION(S)

This Application claims priority to U.S. Provisional Application No. 61/451,961, filed Mar. 11, 2011, the contents of which are incorporated herein by reference.

BACKGROUND OF THE INVENTION

This invention relates to magnesium sheet, and more particularly to an apparatus and method for producing magnesium sheet by roll milling.

The demand for personal electronics, fuel efficient light weight vehicles and other consumer products has driven the demand for competitively priced lightweight materials with a high specific strength and specific stiffness. In recent years magnesium alloy die castings have successfully been used in many applications, but further weight reductions have required the use of wrought magnesium sheet.

Magnesium is a metal with a Hexagonal Close Packed (HCP) crystal structure that has very limited plasticity at room temperature. Until recently, all magnesium sheet was made by hot rolling small ingots and the costs associated with the reheating operation to maintain the metal at rolling temperatures and the small coil sizes made the final sheet prohibitively expensive for consumer applications. In the case of magnesium and magnesium sheet alloys, the HCP crystal structure of the metal limits its deformation abilities at lower temperatures. This required frequent reheating in off-line ovens to maintain the temperature between 250° C. and 450° C. Below this temperature, the metal had a tendency to crack during rolling. Handling and reheating oven constraints limited the maximum slab size and traditionally made magnesium sheet production virtually a sheet-by-sheet operation. This was a very labor and energy intensive, inefficient method of production and contributed to the high cost of magnesium sheet.

Recent advances in twin rolling casting have allowed magnesium alloys to be directly cast into coils of material that are in the range of 4 mm to 7 mm thick, however only small coils of rolled magnesium sheet are available. Conventional rolling processes can only produce small coil sizes because as the ingot is rolled, it gets longer and thinner, which increases the surface area, and therefore loses heat rapidly and gets too cool to roll any further. It is not economical to off-line reheat long sections of rolled slab. Consequently a need exists for a magnesium rolling mill which provides for an industrial rolling process that not only economically reduces the cast coils to the final gauge required by the consumer products, but also has the ability to modify the microstructure of the as-cast magnesium to improve the formability of the rolled sheet, while maintaining a good quality surface that requires minimal treatment after rolling.

SUMMARY OF THE INVENTION

The magnesium rolling mill of the present invention provides an industrial rolling process that not only economically reduces the cast coils to the final gauge required by consumer products, but also modifies the microstructure of the as-cast magnesium to improve the formability of the rolled sheet, while maintaining a good quality surface that requires minimal treatment after rolling. Twin roll casting provides the great advantage of producing very large coils at the same gauge as the coiling gauge from a reversing mill.

The magnesium rolling mill of the present invention consists of a reversing mill, two opposite side hot coilers in possible combination of hot roller tables, material handling equipment and accessories. Magnesium product in the form of plates or coils are reciprocated through the mill until proper temperature is reached and the proper final thickness is obtained without deteriorating the quality of the configuration of the magnesium alloy final product.

The magnesium rolling mill of the present invention provides for rolling multiple passes of the magnesium sheet after the sheet has been brought to an elevated temperature typically between 250° C. and 350° C. The mill provides for intermediate annealing to re-soften the material structure. The mill includes the capability to roll with asymmetrical work roll speeds to introduce more mechanical work and heat into the roll bite and therefore reduce the basal plane texture of the HCP crystal structure of the magnesium thereby improving ductility and low-temperature formability of the rolled strip. The mill of the present invention has the capability to increase rolling speed for overall production capability and to allow a faster deformation speed. The mill includes a work roll diameter that balances the requirement to minimize the length of contact with the magnesium strip being deformed while simultaneously having sufficient torsional rigidity and strength to resist the loads created by the asymmetric rolling condition. The mill has a high speed hydraulic gap correction system capable of working in pressure or position control to accurately control the as-rolled gauge of the magnesium alloy. The mill provides for a higher reduction per pass to achieve better grain refinement and improve the general mechanical properties of the rolled strip. The mill includes high force actuators to provide work roll mechanical bending for strip shape correction and includes a coil to coil processing as well as plate to plate or plate to coil processing.

The magnesium rolling mill of the present invention is equipped with heated coilers with sufficient heating capability to warm the coil to the best rolling temperature and to maintain the temperature during rolling passes. The mill further includes an additional hot chamber for additional instant heating of the magnesium strip end being reversed at the coiler. The mill can also include a combination pay off-rewind reel for initial loading and feeding of a cold or preheated coil and for rewinding of the final product. The mill can include an optional stand-alone rewind for final coiling of the processed coil.

In addition to the sensors required to operate a normal rolling mill, the mill is also equipped with thickness gauges, rolled strip shape measurement and temperature monitoring and control of the strip. The mill includes work roll brushes for magnesium pick up and removal. A lubricant application system is incorporated for use when not rolling in the asymmetric mode.

The mill further can include strip guiding and heating system for rolling sheet/plates rather than coils. In this mode of operation strip guides are used to bridge the coil boxes. A strip cooling system prior to final coiling at rewind is included to prevent gain growth during slow cooling of the coil. The mill includes a heavy duty drive system with possible gear shift for higher torque for asymmetrical rolling. The mill includes heated work rolls to minimize strip temperature loses when contacting the rolls during casting.

The method for roll casting magnesium sheet includes a cold or preheated magnesium alloy in the form of a coil being loaded onto a pay off reel or onto a dual function pay off/rewind reel. A first wrap of the coil is peeled off and fed toward the mill. A strip head is pinched and straightened by the entry-pinch roll and flattener unit. The strip head is then conditioned by the entry shear as necessary. The strip head is pushed thru a hot coiler to the mill bite and is coiled onto the opposite side hot coiler. If the coil is at rolling temperature the rolling mill is used for reduction of the strip thickness. If the coil is below rolling temperature, the rolling mill is used as a pinch roll to help feed the strip. The strip can then be uncoiled and recoiled between the two hot coiler units until their proper strip temperature and temperature uniformity is reached. Once the strip is at rolling temperature it is then rolled in several passes until final thickness is reached. The strip is then threaded to the dual function pay off/rewind or optional dedicated rewind where it is coiled and removed off line as a final product. During the process the line is controlled by an automation system that determines the number of passes, temperature, reduction and thickness, speed, profile and shape of the desired final product. In case of plate rolling, heated roller tables on the entry and exit side of the mill are used to reciprocate magnesium alloy plates until rolling temperature is reached until plate thickness is reduced to a value that can be handled by the hot coilers. Then entry and exit side heated roller tables are traversed off line and the described reciprocating rolling between the hot coilers is started.

DETAILED DESCRIPTION

Figure 1A:
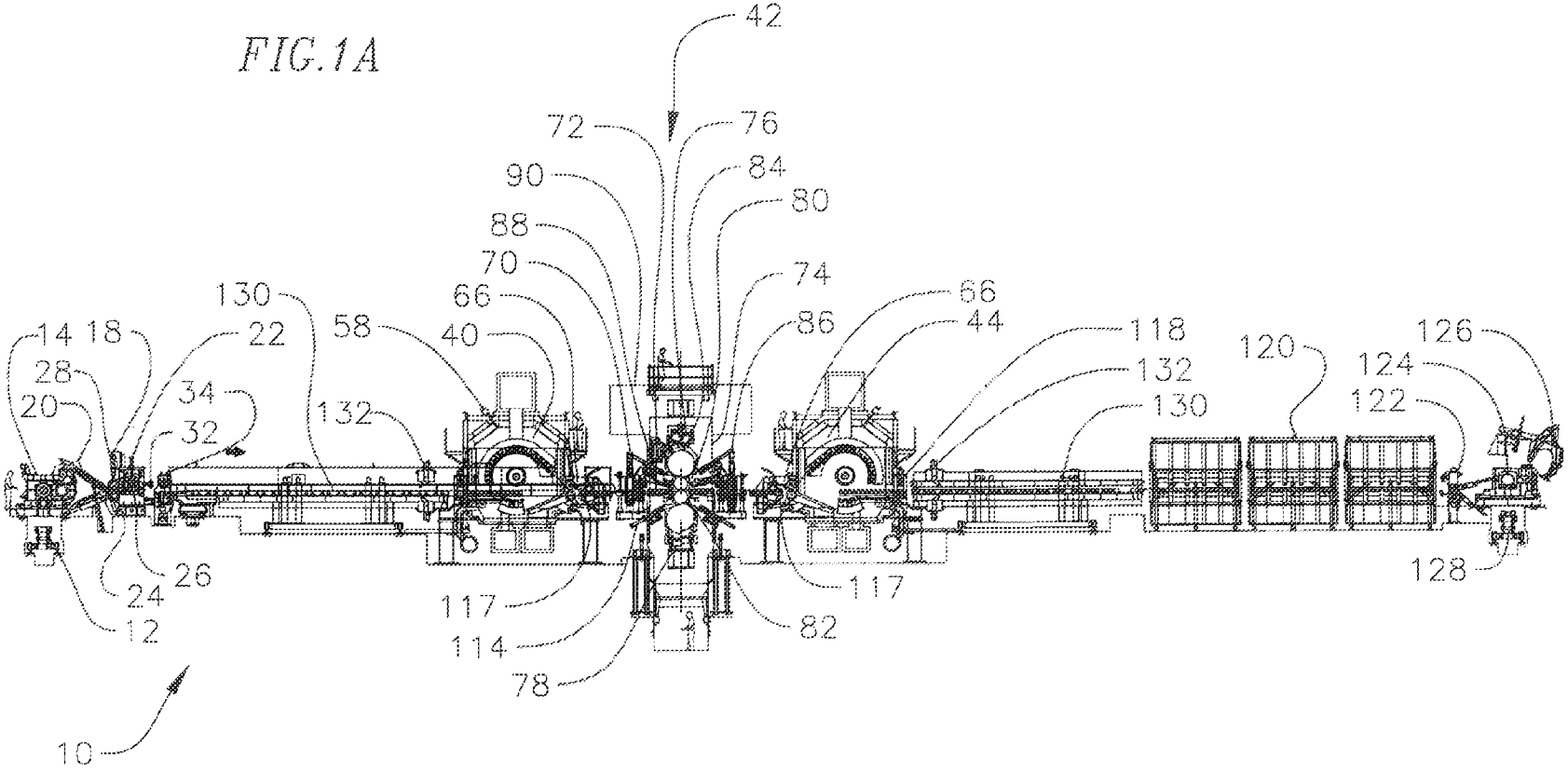
FIG. 1A is a front view of a magnesium rolling mill of the present invention.
Figure 1B:
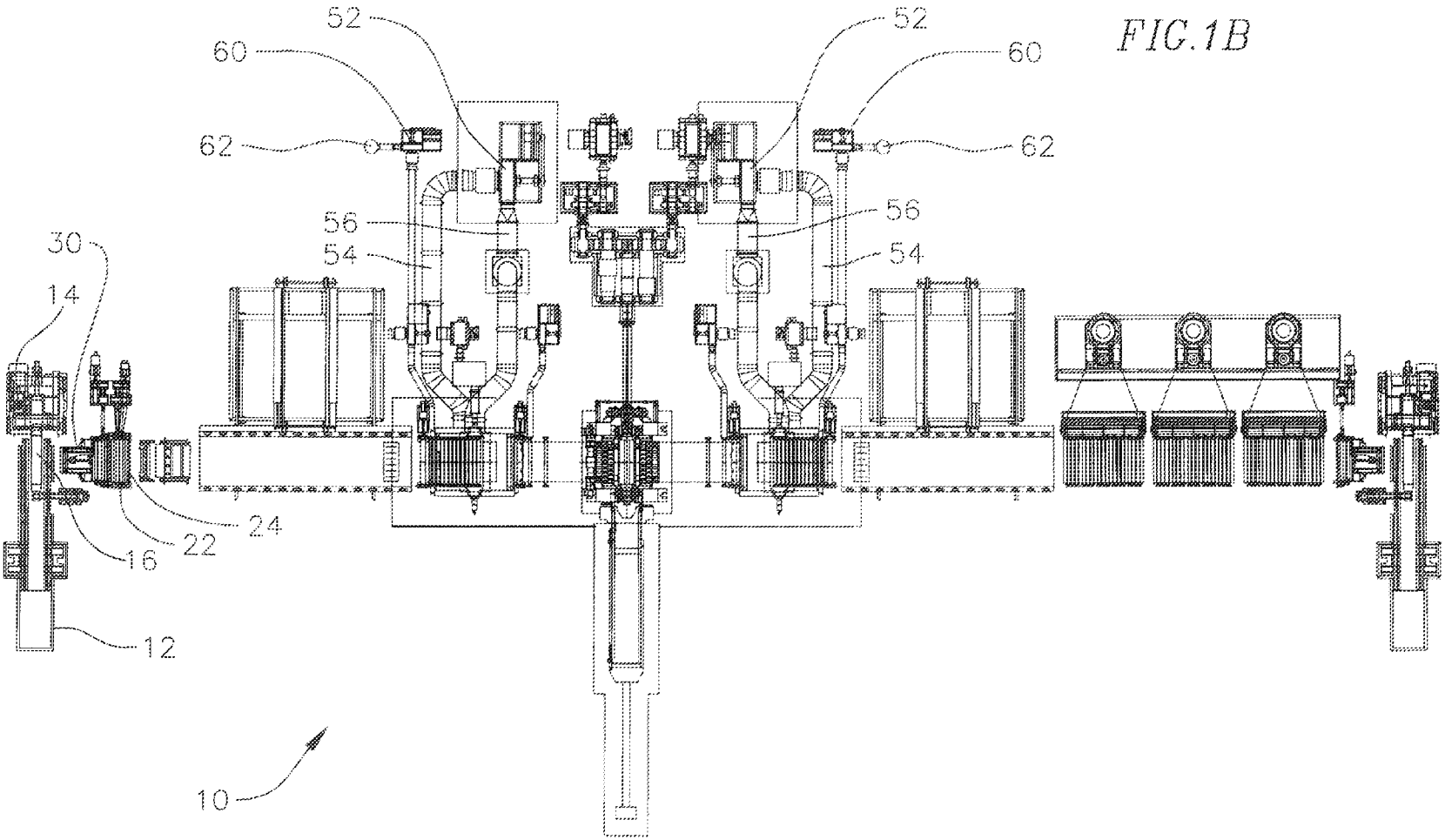
FIG. 1B is a top view of the rolling mill of FIG. 1A.

Referring to FIGS. 1A and 1B, an exemplary magnesium rolling mill 10 of the present invention is illustrated. The magnesium rolling mill 10 is a plate or coil rolling mill having independent pay off reel and unloading or rewind reels. The mill 10 includes an entry coil car 12 to receive a warm or cold magnesium coil from storage which loads it to a pay off reel 14. From a storage and cooling area, the coils to be rolled are loaded onto coil storage saddles using an overhead crane. The coil saddles straddle a coil car pit. The coil car 12 travels perpendicularly to the rolling direction to collect the coil from the coil storage saddles. The coil is picked up by the coil car, and traversed to the pay off reel 14. The coil car moves by a hydraulic motor and lifts the coil by a hydraulic cylinder. Laser sensors are used to monitor the lift and trends verse position of the coil car in order to automate the coil handling cycle. The coil car runs on rails.

The pay off reel 14 has an expanding mandrel 16 which is used to grip and support the coil and feed it to the central processing equipment and provide adequate tension for a tight winding at the hot coiler. The pay off reel also provides for side shifting of the coil for strip center control during operation of the mill. The expanding mandrel of the pay off-reel is a cantilever type mandrel with an out-board bearing support. The mandrel is a four segment interlocking design with wedge expansion. Expansion of the mandrel occurs hydraulically to set the final coil internal diameter (ID) and to grab the incoming coil ID. The coil diameter and width measuring system of the pay off reel is based on a laser type sensor which measures the coil diameter and one photo cell measures the coil width. The signal from the sensor is used for slow-down and tension compensation functions. The pay off reel controls the coil car traverse and lift in order to center the coil on the pay off mandrel. The pay off reel includes a strip centering device having a strip position sensing detector and signal processors to control position by moving the pay off reel on each side of the mill center line during rolling operation. The combination pay off reel also includes a coil stripper which is mounted on top of a gear reducer to avoid telescoping during coil removal. A stripper plate is supported by steel guide rods and is hydraulically operated.

After the pay off reel, the mill includes a coil preparation unit 18. The coil preparation unit consists of a strip peeler 20, a pinch roll 22 with deflector roll 24 and a flattener unit 26. The pinch roll 22 assists feeding of the first wrap of the unrolled coil and to hold the last wrap of the final coil after rolling. The pinch roll consists of a solid steel roll mounted on roller bearings and driven by an AC motor. A hydraulic cylinder 28 presses the roll against the coil. A tilting and extendable feeding table 30 is positioned between the pay off reel 14 and the deflector roll 24. After the strip passes between the pinch roll and the deflector roll, it passes through the flattener unit 26 which consists of a five roll configuration driven by an electric motor having the two top rolls with an electric screw jack actuator for independent roll penetration setting. A strip center control which is an optical sensor 32 is positioned on the coil preparation unit as the coil strip exits the flattener unit 26. Sensor 32 is an optical type EMG or equivalent and has a double function for strip centering online during payoff operation and strip centering or edge alignment for the coil during the rewind operation.

Figure 2A:
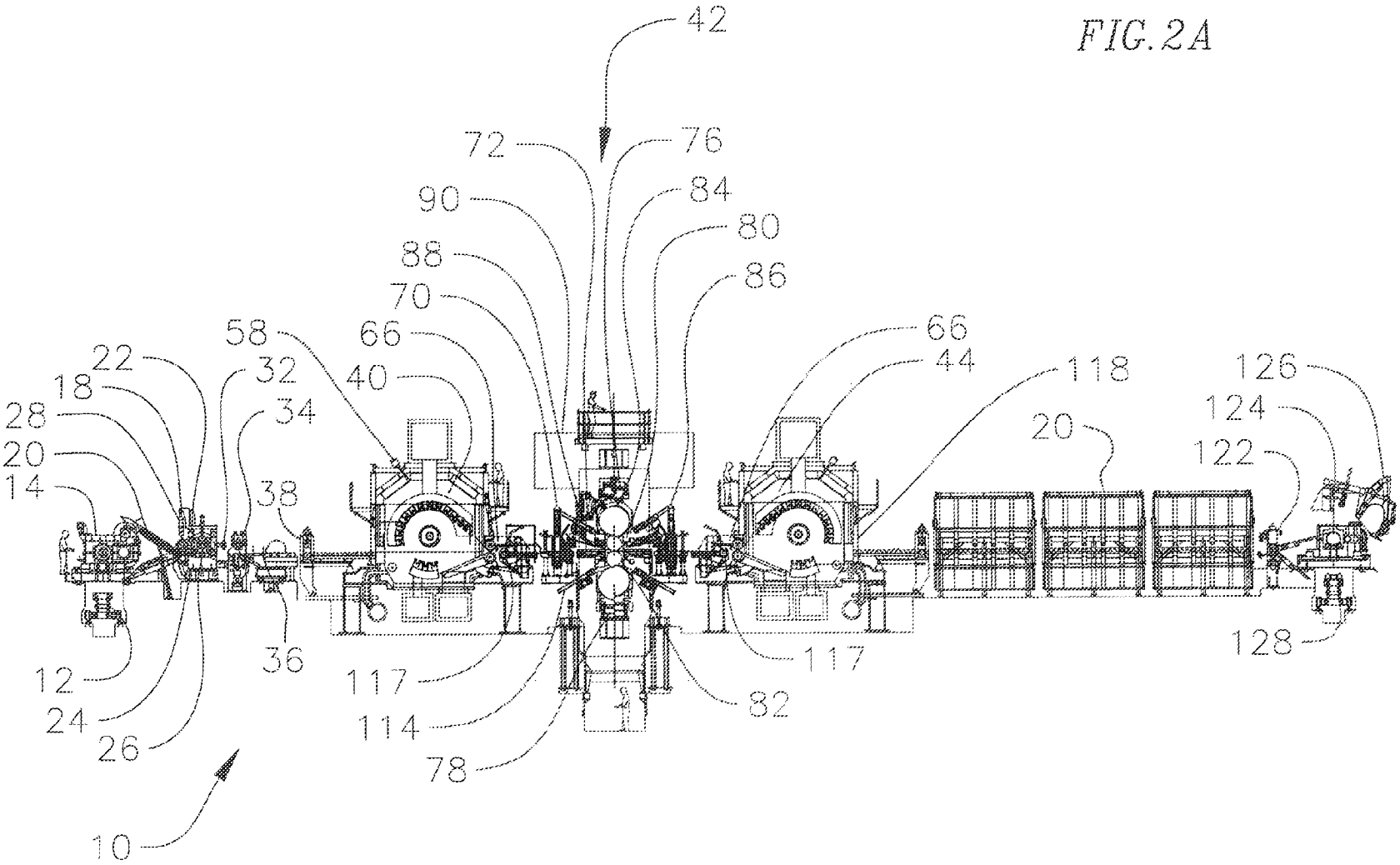
FIG. 2A is a front view of an alternative embodiment rolling mill of the present invention.
Figure 2B:
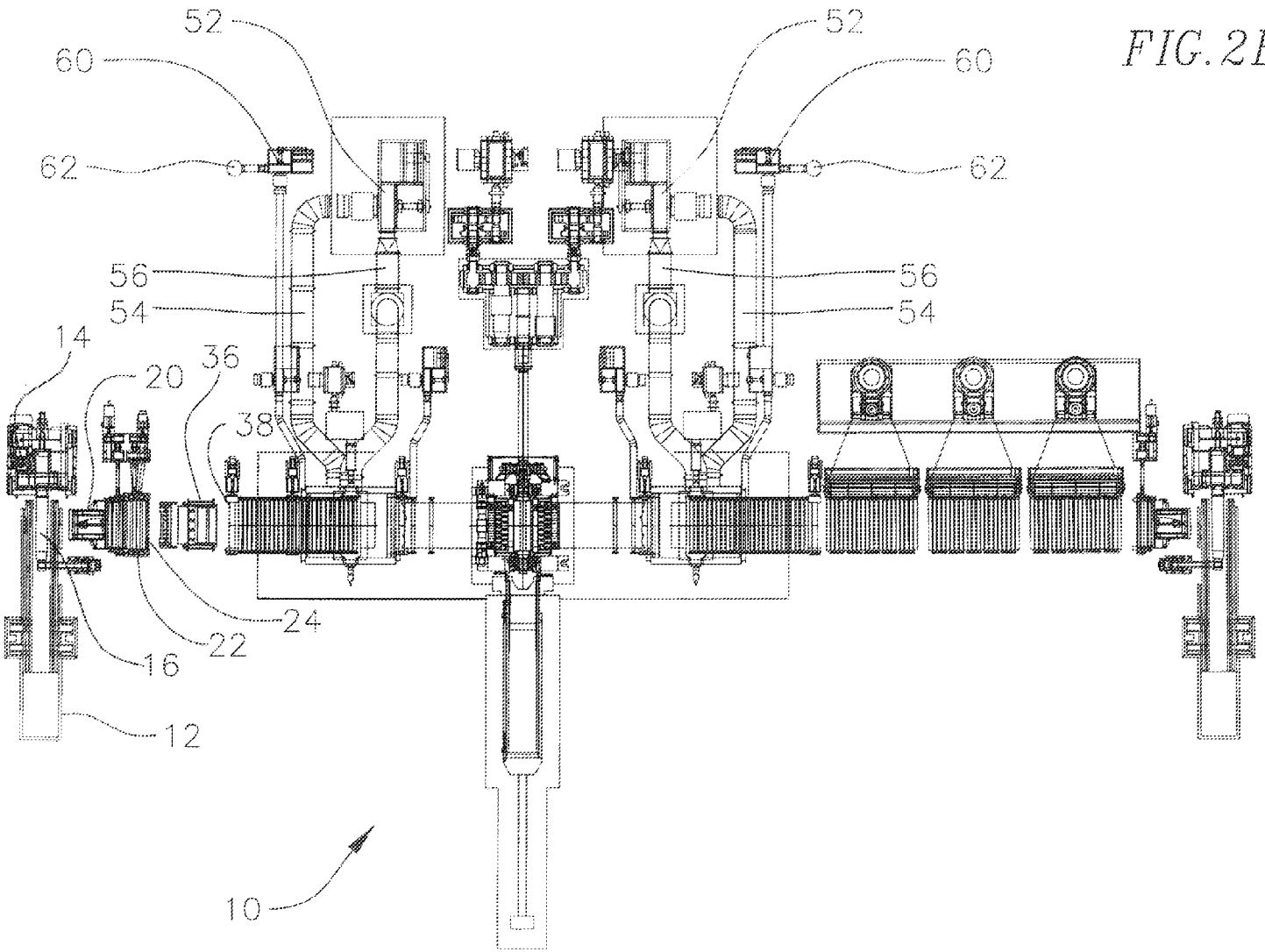
FIG. 2B is a top view of the rolling mill of FIG. 2A.

The strip after passing the optical sensor, enters a strip shear 34 to condition the strip head prior to entering a threading table 36 and feeding pinch roll 38 as can best be seen in FIGS. 2A and 2B. FIGS. 1A and 1B illustrate an active thermal roller table, which will be discussed in detail subsequently herein, positioned between the strip shear and the pinch roll. The threading table and feeding pinch roll feed the coil through a left hot coiler 40. The pinch roll and feeding table are mounted on a frame which is traversed by a motor and a rack and pinion drive system to span inside the left hot coiler when necessary and is retracted during reversing mill intermediate passes. The pinch roll is driven by an electric motor and vertically actuated by a hydraulic cylinder. The feeding table consists of a series of stainless steel V-shaped idler rolls.

Left hot coiler 40 is positioned on the left side of roll mill 42 and a right hot coiler 44 is positioned on the right side of roll mill 42. Left hot coiler 40 and right hot coiler 44 are mirror images of each other. Each of the left hot coiler and the right hot coiler are enclosed by an insulated enclosure 46. Within the enclosure, an arrangement of ducts 48 with slot nozzles 50 surrounds approximately seventy-five percent of the coil circumference. An insulated circulation fan 52 with duct work 54 connects to each enclosure to supply hot air to the nozzles. Impingement of hot air upon the strip surface provides convective heat transfer for heating the strip. With convective heating, no part of the coil will ever be heated above air temperature, which prevents any portion of the magnesium strip from igniting. Ignition can occur with radiant heating and therefore has been eliminated. An insulated heating chamber in the circulation fan discharge ductwork provides space for mounting a gas burner or electric heating elements 56 to heat the air prior to delivery of the preheated air to the nozzles within the enclosure. A thermocouple 58 is located in the ductwork prior to the nozzles and provides the necessary feedback for modulating air temperature control. An exhaust fan 60 is added to provide negative pressure to the coiler to preserve the working environment from heat leaks. Exhaust hot air is pushed through a stack 62 out of the building.

Ductwork inside the hot coilers is constructed out of stainless steel and has supports to maintain accurate nozzle position. Duct headers have removable door plates for access to the duct interior for cleaning purposes. The coiler enclosures are constructed of mild steel plate reinforced by channels and angles on the outside with approximately eight inches of ceramic fiber insulation on the inside face. The ceramic fiber is anchored to the mild steel plate. All joints between sections and access doors are gasketed to minimize heat leakage. The perimeter formed channels are slotted to minimize heat conduction to the outside surface. Ports are provided for test purposes, and installation of thermocouples. A man access door is provided for maintenance access and cleaning purposes. The enclosures are flanged to allow them to be split horizontally for major maintenance. In order to access the interior of the hot coilers, a forty-five degree flange 64 is positioned in the ductwork that feeds the top of the enclosure. The enclosure in its working position compresses the gasket on the flange. To access the inside of the coiler enclosure the flange is lifted straight up to automatically disengage the duct at the forty-five degree flange. Alternatively, access can be obtained by having the bottom half of the enclosure slide transversely on rails.

The strip exits the first or left hot coiler to the roll mill 42 through a pinch roll 66 and deflector roll 68 arrangement. The deflector roll and pinch roll reduces the hot coiler opening and minimizes heat losses, holds the strip tail when released by the rolling mill bite and feeds the new strip head to the roll bite.

The strip after passing through the deflector roll and pinch roll passes by a thickness sensor 70 which is retractable and pivotable and can be isotope or x-ray as required to measure the thickness of the strip. The sensor also could possibly have a scanning function to measure gauge or use multi-head gauges in order to measure the strip profile. There is one entry and one exit thickness sensor, each with a source housing, detector housing and a steel C-frame. Track and pneumatic drive mechanism supports the sensor housings. A strip guide and cobble guard 72 is positioned on the roll mill prior to the roll bite to direct the strip to the roll bite and to prevent potential cobbles when rolling under extreme conditions.

The roll mill 42 has a mill housing 74 made of cast steel and is machined on four sides and is mounted on base beams. When fabricated, steel top and bottom spreaders connect the housings on either side. The housings rests on two fabricated steel bases. A fabricated steel plate is provided for alignment and installation by anchor bolts. The design provides high mill stand stiffness to obtain tight finished product tolerances during all milling passes.

A rolling gap is controlled by two load cylinders mounted at the top of each housing. A pass line is kept constant by a bottom mounted wedge system. A fluid collecting tray is welded to the base plates under the mill stand. Under the mill, and over the coolant collecting tray, a steel mesh grid tray is provided to collect scrap pieces. The mill housing is a high stiffness closed ring type for two-high, four-high or six-high configurations. The mill housing has also been designed with the possibility of incorporating transversally shiftable rolls. The load cylinders are top or bottom mounted hydraulic roll force cylinder 76 to control rolling load and roll position. The pass line system can be a top or bottom mounted continuous or step-type system to compensate for variations in roll diameter, and is as shown in the figures is a bottom mounted wedge system 78.

The rolling mill includes a roll bending housing extension 80 which includes a high pressure hydraulic cylinder to mechanically provide bending of the rolls for strip shape compensation. The roll bending housing extension is shiftable to follow roll position if required by mill configuration and can be utilized for the work rolls and intermediate rolls when applicable. The rolling force is applied by the two hydraulic cylinders, mounted in the roll housing windows, over the top back-up roll chocks, one cylinder on each side. The cylinders are double effect type, with a centrally mounted position transducer having low friction seals. The stroke of the cylinders is sufficient to maintain the pass-line height by compensating the entire range of diameter change of the top work roll and the top back-up roll due to roll grinding. Additional stroke allows work roll and back-up roll extraction. A high-resolution digital position transducer is centrally mounted in each load cylinder. Pressure transducers mounted on the high-pressure hydraulic line provide the value of the rolling force. The cylinders are used to hold the pass line of the top half of the stack as roll diameters decrease due to grinding, to provide rolling force, to maintain gap control and to provide mill steer control. The rolling force exerted by the cylinders causes elastic deformation in the rolls which is compensated by the mechanical roll crown ground into the rolls. The bottom half of the roll stack is brought to the pass-line by means of the wedge system located at the bottom of the housing. The wedges have enough stroke to accommodate the entire range of the roll grind-down for the bottom half of the roll stack.

The rolling mill includes a work roll assembly 82, which are two rolls in a two-high or a four-high configuration. Backup rolls 84 are positioned adjacent the two work rolls. In a six-high configuration an intermediate roll would be positioned between the work rolls and the back-up rolls. The work rolls, intermediate rolls and back-up rolls have cooled bearings and can be heated by internal or external heating elements. Rotating roll brushes 86 are positioned over the work rolls for top and bottom work roll metal pick up removal. The roll brushes are pressure or position controlled for adjustable clean up of the work roll. The roll brushes can oscillate and can be equipped with a vacuum system for dust removal. Spray bars 88 are positioned along the top and bottom and both sides of the mill to allow possible rolling from dry conditions to wet or lubricated conditions to a more flooded condition. The spray bars could be zoned controlled to several width adjustments. The roll mill can include an enclosure with an exhaust system 90, for a fully enclosed system to provide a clean operator working environment.

The work rolls are made of electro slag remelted (ESR) forged alloy steel. The work roll bearings are four-row tapered roller bearings and have four steel chocks, complete with bearing spacers, lock nuts, locking rings, seals and end covers. The chock side faces are fitted with replaceable bronze wear liners. Chocks are cooled to control bearing temperature to optimize lubrication. The bending control are E-block assemblies bolted to each side of the mill window approximately 120 ton per chock. The work rolls can be internally heated with 68 kW resistance heaters located in the central axis of the rolls. Heaters are encased in a cooper based alloy sleeve for good conduction and uniform distribution of heat into the roll body. Power to the heaters is provided by means of a rotating electrical distributor that attaches to the operator side roll end. The heaters provide a base line thermal input which is then modified by the induction heating system for profile control in reaching the final working temperature of the rolls. The back-up rolls are forged alloy steel and have four 4-row tapered roller bearings and four cast steel chocks. The bottom back-up roll chocks are fitted with steel rocker pads for perfect contact with the bottom wedges of the pass-line adjustment system. The bottom back-up roll chocks are fitted with wheels, running on rails fixed inside the mill housing. The work roll and back-up roll chocks are retained in the mill housings by hydraulically operated chock keeper plates attached to the housing.

The pass-line is automatically maintained at constant height irrespective of roll diameter changes by means of a motor-driven wedge-type mechanism mounted in the bottom of the mill. Two alloy-steel, hardened and ground wedge assemblies are mounted between the bottom back-up roll chocks and the mill housing windows. Hardened and ground steel rocker plates are fixed to the bottom back-up roll chocks. The wedges are operated by a screw actuator driven by a hydraulic motor. The actual position of the wedges is controlled by a position transducer. Over-stroke control of the wedges is by means of proximity switches. The control is integrated into the mill main control system and is fully automatic. After roll change, the operator enters the new roll diameter value into the system, which calculates the new position of the wedges, and provides the necessary drive to the hydraulic motor.

Figure 4A:
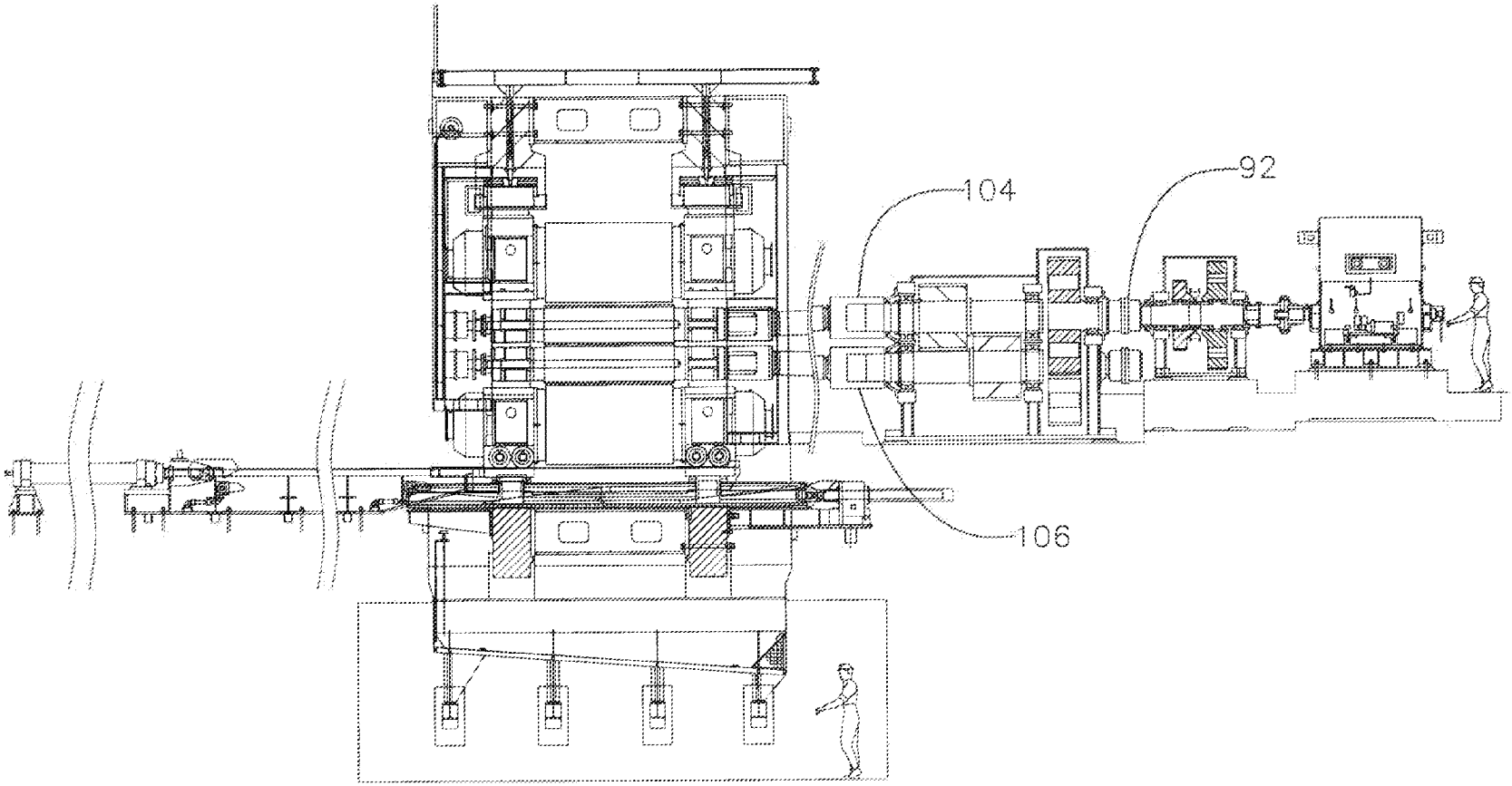
FIG. 4A is a front detail view of the mill drive system of the mill of FIG. 1A.
Figure 4B:
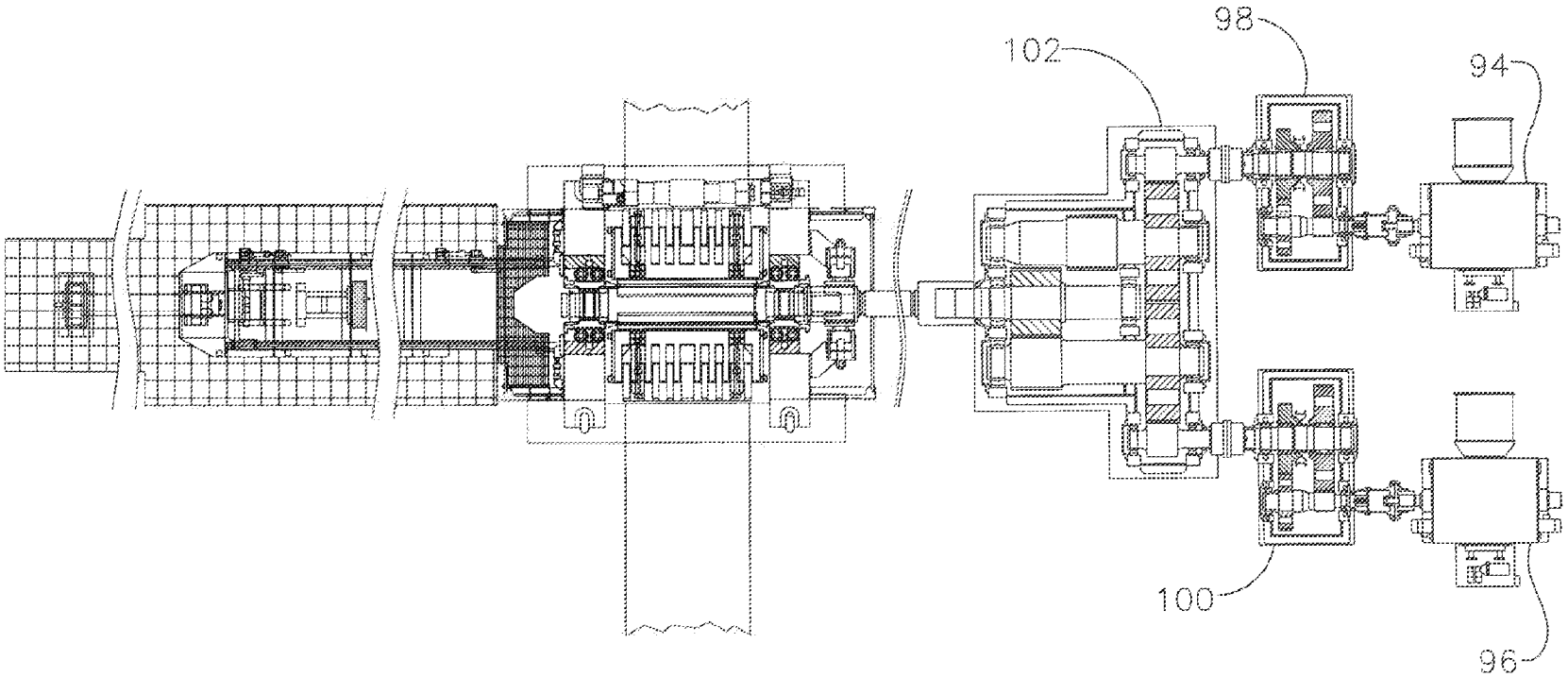
FIG. 4B is a top view of the drive system of FIG. 4A.

As also can be seen in FIGS. 4A and 4B, the rolling mill has a mill drive system 92. The work rolls are independently driven by electric motors 94 and 96. The drive system includes a gear reducer 102 and drive spindles 104 and 106. The drive spindles are individually controlled to provide asymmetrical shear rolling where motor torques are adjusted to maximize the internal deformation of the magnesium roll strip to generate a more uniform micro structure with a texture that has better ductility during subsequent forming operations. The gear shift allows low speed running at extremely high torque to better accomplish the asymmetric rolling process.

Figure 4C:
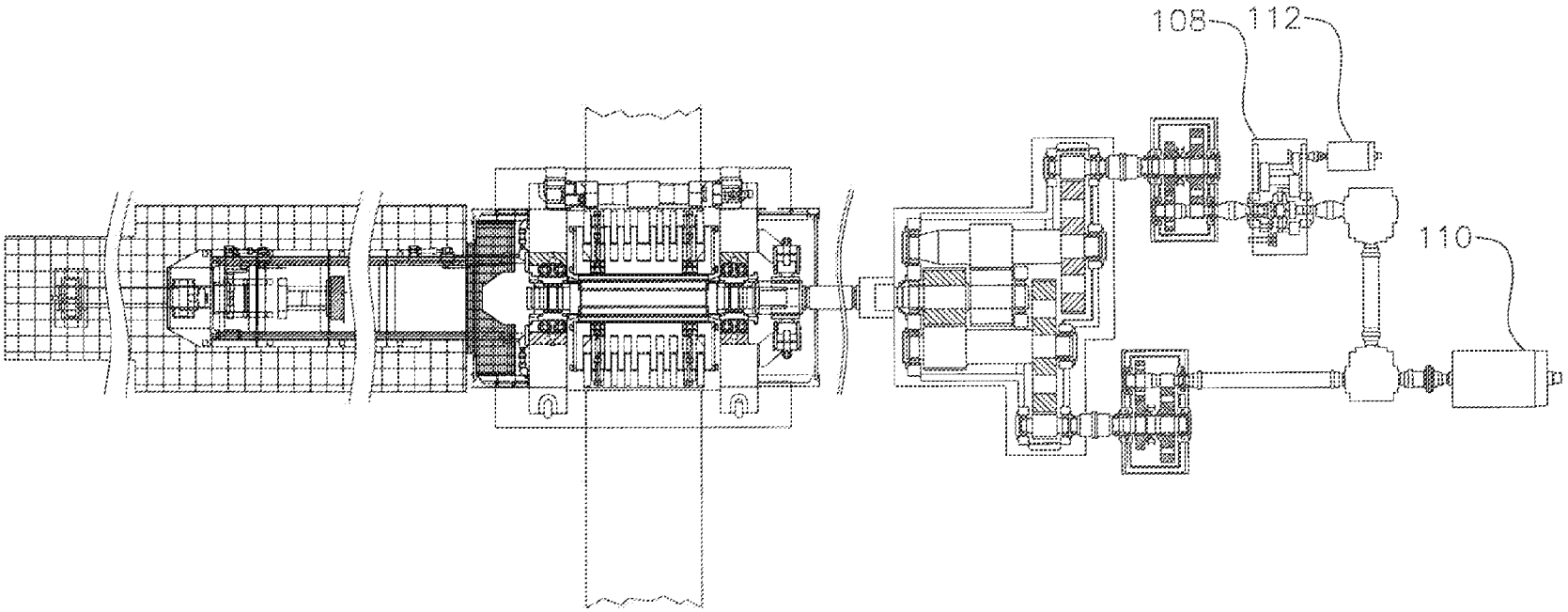
FIG. 4C is a top view of an alternative mill drive system.

As seen in FIG. 4C alternatively the mill drive system can include a configuration wherein the top and bottom work roll drive system is mechanically connected through a differential gear system 108. The differential gear system can be a planetary automotive type to allow torque regeneration from the drag roll of the asymmetrical rolling condition of the driven roll. A main motor 110 is used for the mill drive and an auxiliary smaller motor 112 is used for differential speed correction. Alternatively, the differential gear system can be epicyclic. For example, asymmetric rolling of the present invention produced a 3:1 difference in speed between the work rolls resulting in dramatically improved refinement of the as-rolled microstructure of the strip.

External roll heating elements 114 are positioned for each of the top and bottom work roll. The external roll heating elements have a heating capability of 350° C. The external roll heating elements are full width induction type with segments that allow individual control across the width of the roll providing the ability to control the thermo profile/crown of the roll. Internal heating elements 116 are also positioned for the top and bottom work roll. The heating capability of the internal heating elements is approximately 150° C. as stand alone elements. The internal heating elements are electric and are located in a longitudinal bore in the central axis of the roll. The internal heating elements have an expandable sheath design that provides intimate contact with the work roll body to provide excellent thermal conductivity and optimize power input. The internal heating elements are equipped with high speed rotating electrical contacts.

Shape rolls 117 are positioned adjacent the hot coilers and measure the shape of the strip during each pass and provides closed-loop control to the actuators. The shape roll can withstand the elevated temperatures used for magnesium rolling and is commercially available from ABB sold under the trade name Stressometer Roll. The shape roll provides strip tension measurement both across and along the rolled magnesium strip.

A feed control with threading table 118 is positioned on an exit side of the right hot coiler for traversing the magnesium strip with a pinch-roll unit to by-pass the right hot coiler during final feeding of the strip to the rewind.

A strip cooling system 120 includes a forced air cooling header to reduce strip temperature before final coiling at the rewinder. The strip cooling system can include mist cooling or water cooling followed by an air knife to dry the strip in applications where a following processing step can tolerate some minor strip surface oxidation. An exit deflector roll 122 is adjacent the strip cooling system to pinch and deflect the magnesium strip toward the rewinder and to provide a good wrapping angle for coiling stability. The rewinder 124 is adjacent a shape meter roll for tight coiling of the final strip to the proper internal diameter dimension as required by the particular application of the magnesium strip. A belt wrapper 126 is a part of the rewinder to initiate the first coiling on the rewind mandrel. An exit coil car 128 unloads the final coil strip for movement to an off line location.

The magnesium rolling mill system 10 of the present invention can incorporate an active thermal roller table 130 which is used for reverse rolling of magnesium sheet or plate. The roller table is equipped with hot air injectors 132 which are capable of warming from ambient temperature to approximately 500° C. The thermal roller table can be positioned on either side of the rolling mill system adjacent the hot coilers and the hot coilers could not be used for plate application or only partially used as needed. The active thermal roller tables can be traversed off line when magnesium strip is coiled between the hot coilers.

The magnesium rolling mill system of FIGS. 1A and 1B have independent loading, payoff reel and unloading rewinder and can be used for magnesium plate and magnesium coil rolling. The magnesium rolling mill system of FIGS. 2A and 2B have independent loading payoff reel and unloading rewinder but is a configuration for magnesium coil rolling only as it does not incorporate an active thermal roller table.

Figure 3A:
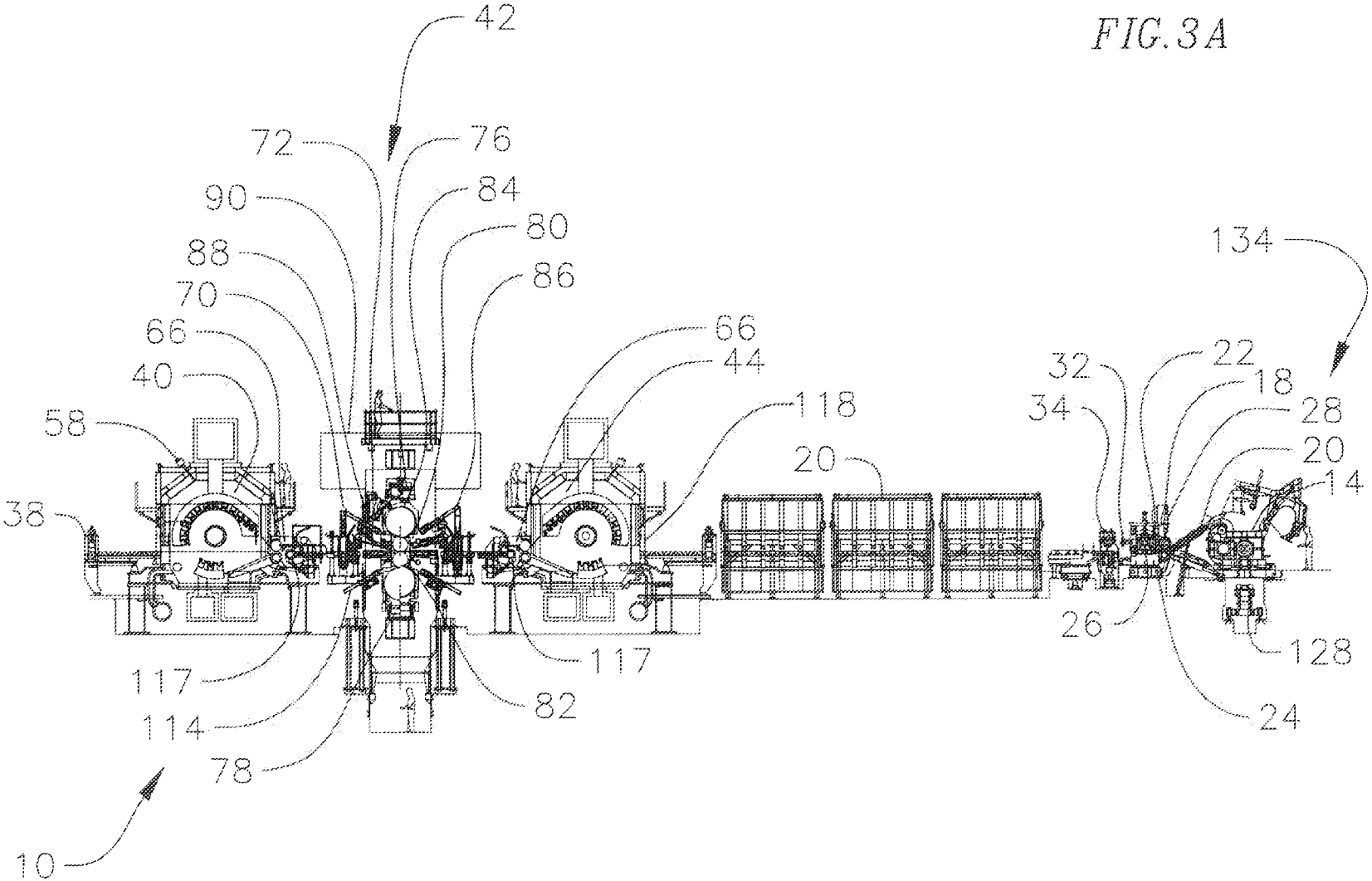
FIG. 3A is a second alternative embodiment magnesium rolling mill of the present invention.
Figure 3B:
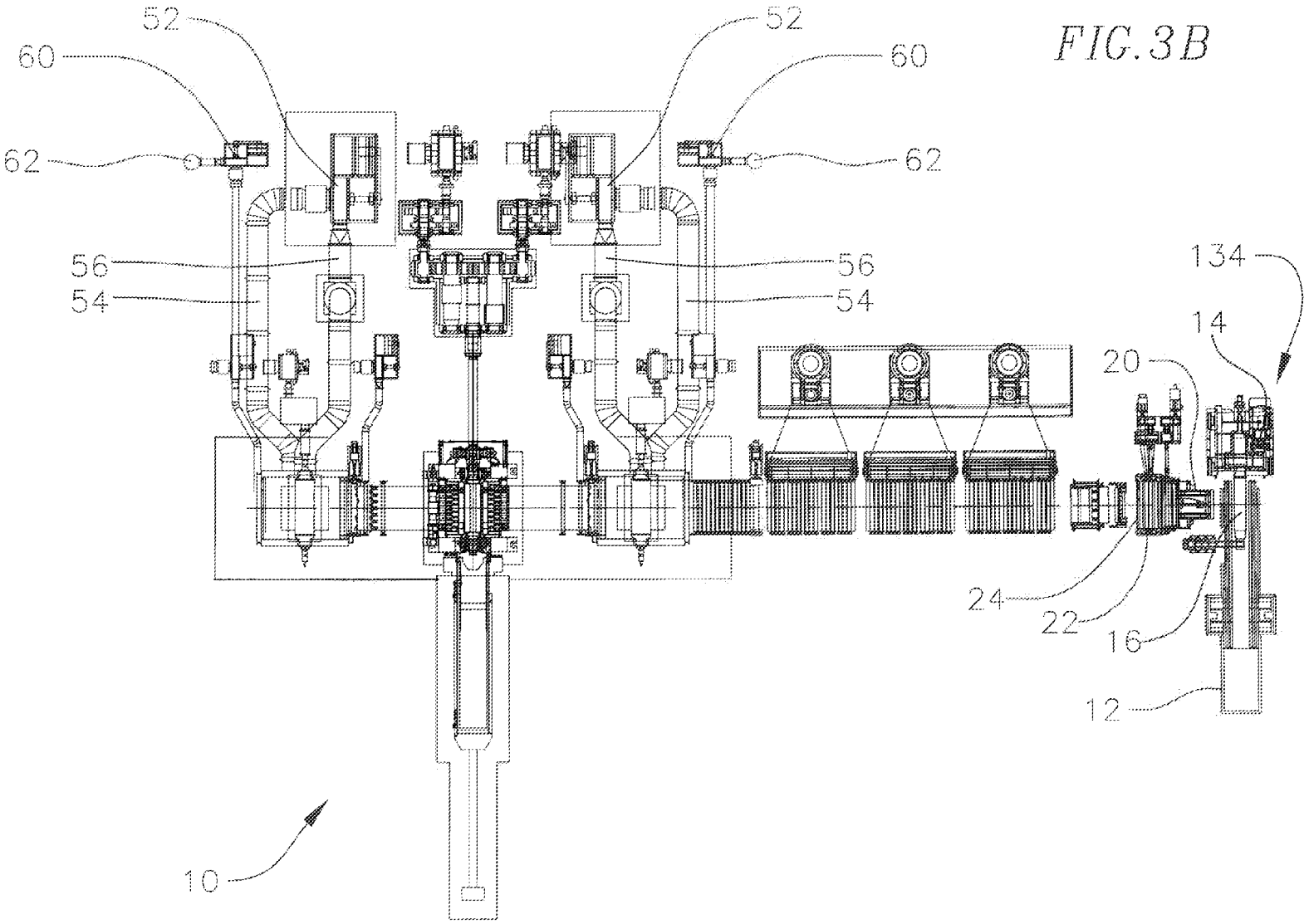
FIG. 3B is a top view of the rolling mill of FIG. 3A.
Figure 5:
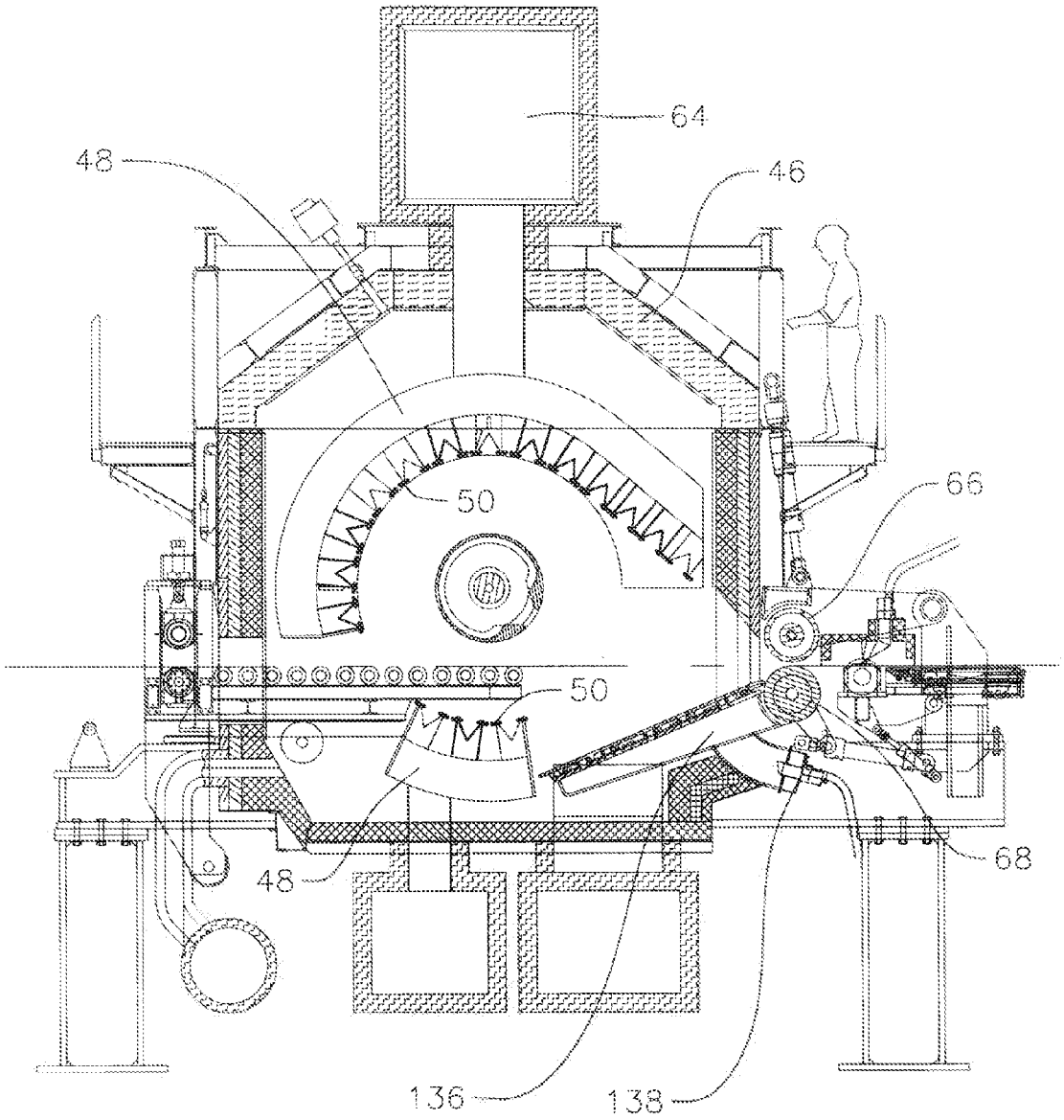
FIG. 5 is a cross sectional detail view of the hot coiler of the rolling mill of FIG. 1A.

FIGS. 3A and 3B illustrate an magnesium rolling mill system for magnesium coil rolling which combines loading and unloading of the magnesium coil by having a dual function payoff and rewind reel 134. The dual function payoff and rewind reel is an alternative single unit having the double function payoff reel and rewind reel to be used for first unpeeling of the new coil and final winding of the finished coil. As can be seen in FIG. 5 the hot coiler can have a threading apron with integrated hot air nozzles 136 fed by hot air injectors 138.

Some of the features and advantages of the present invention include a magnesium rolling mill system incorporating hot coilers for magnesium alloy processing designed to produce tight winding and back tension to the strip being rolled while maintaining the proper rolling temperature. The hot coilers are convection type for faster heating consisting of a recirculating fan, heat exchanger, insulated ducting, modulated air valves and top, bottom and side air nozzles to push hot air against the surface of the coil being wound. An additional exhaust fan will assure the negative pressure of the hot coiler to avoid heat dispersion in the working environment. A separate heating chamber extension quickly raises the temperature of the strip ends. The chamber is located above the tail of the coil that remains outside of the hot coiler enclosure when the coil is fully wound onto one of the hot coilers. The tail must remain outside of the enclosure to facilitate the rethreading of the mill for the next pass. The heating chamber is built onto the deflector roll pivot plane. This design places the chamber close to the tail when the deflector roll is closed and optimizes heat transfer. The chamber is equipped with hot air ejectors capable of warming ambient air to 500° C.

The magnesium rolling mill system of the present invention provides for the hot coiler to be bypassed by traversing feeding tables. The roller table with a pinch roll will grab the strip being fed to the mill or to the rewind to bypass the hot coiler area. The roller table is then retracted to the home position when magnesium alloy is processed through the hot coilers.

Another advantage of the rolling mill system of the present invention is a double speed independent main drive system for asymmetrical rolling for magnesium processing using two independent main motors. Low speed is used to provide high torque as required for asymmetrical rolling when strip and roll bite is pushed and pulled by the two work rolls to enhance microstructural refinement by increasing shear and heat generation. The resulting microstructure is less prone to cracking during subsequent forming operations. Alternatively, a double speed independent main drive system for asymmetrical rolling for magnesium processing uses a mechanical regeneration system with a single main motor and a differential gearing driven actuator.

Another advantage of the present invention is work roll heating internally and externally for magnesium rolling. External heating is by induction heating for the roll surface. Inductors are zone type to allow differential temperature across the roll with so that a controlled thermal roll crown is possible for strip shape/profile correction. Internal heating is assured by specific electric heating elements located in the roll core that make good thermal contact with the roll body to quickly transfer heat. Roll temperature will be approximately 300° C. to avoid removing heat from the strip being rolled when it contacts the work rolls. To improve the production output of the mill pre-warmed coils can be loaded onto the payoff reel and directly feed to the mill. This would reduce or eliminate the need for any on-mill heating prior to the first pass.

To provide the possibility of accelerated cooling in order to suppress any tendency for grain growth on the rewind after cooling, the magnesium rolling mill system includes a cooling system that maintains the enhanced physical properties of the fine grain sheet produced by the mill.

Insulated and heated roller tables with covers can be located on both sides of the rolling mill to heat magnesium plate to the temperature required for rolling and can be located either outboard of the hot coilers and/or between hot coilers and the rolling mill. In the inboard position they would raise the temperature of the strip being rolled between the hot coilers.

Another advantage of the magnesium rolling mill system of the present invention is the use of a dual function payoff reel and rewind unit which reduces the overall total line length and investment cost of the system. Mandrel expansion on the unit can be controlled to two diameters, a larger diameter to handle the open eye coils that are normally produced by a twin roll caster and a second smaller diameter to accommodate the use of spool so that the thinner rolled material can be wound onto these spools for subsequent processing operations.

Although the present invention has been described and illustrated with respect to several embodiments thereof, it is to be understood that changes and modifications can be made therein which are within the scope of the invention as hereinafter claimed.

What is claimed is:

1. A magnesium rolling mill for reducing cast magnesium coils to a final gauge comprising:

a reversing rolling mill having at least two work rolls for rolling of magnesium sheet;

a hot coiler positioned on either side of the rolling mill having ducts with slotted air nozzles within the hot coiler for heating and maintaining a required temperature of the magnesium sheet being rolled by the roll mill to achieve the final gauge; and wherein the hot coiler is a convection type heater having an insulated housing and the ducts and air nozzles are positioned within the top, bottom and sides of the insulated housing for directing hot air against the top, bottom and sides of the magnesium sheet to prevent the magnesium sheet from being heated above air temperature.

2. The mill of claim 1 wherein the hot coiler includes an exhaust fan.

3. The mill of claim 1 further comprising a heating chamber extension adjacent the hot coiler to heat an end of the magnesium sheet outside of the hot coiler.

4. The mill of claim 1 further comprising an active thermal roller table for heating magnesium sheet or magnesium plate.

5. The mill of claim 4 wherein the roller table has hot air injectors to heat the magnesium sheet or magnesium plate.

6. The mill of claim 1 further comprising a mill drive system wherein the work rolls are independently driven for asymmetrical rolling of the magnesium sheet.

7. The mill of claim 6 wherein each work roll is driven by an independent motor.

8. The mill of claim 6 wherein one work roll is driven by a main independent motor and another work roll is driven by a differential gear system and an auxiliary motor.

9. The mill of claim 1 wherein the work rolls are heated externally by zone inductors to allow differential temperature across a roll width so that a controlled thermal roll crown is produced for magnesium sheet strip shape or profile correction.

10. The mill of claim 1 wherein the work rolls have internal heating elements within a core of the work rolls.

11. The mill of claim 1 further comprising at least one feed table and pinch-roll.

12. The mill of claim 1 further comprising a warm coil loading and payoff station.

13. The mill of claim 1 further comprising a cooling system for final coiling of the magnesium sheet.

14. The mill of claim 1 further comprising a dual function payoff reel and rewind station.

15. The mill of claim 1 further comprising a double stroke hot coiler deflector roll to seal the hot coiler.

16. The mill of claim 1 further comprising a hot coiler threading apron with integrated hot air nozzles fed by hot air injectors.

17. The mill of claim 1 wherein the hot coiler further includes a flange in duct work feeding the insulated housing for access to an interior of the insulated housing.

18. A magnesium hot rolling mill system comprising:

a reversing rolling mill having at least two work rolls for rolling of magnesium sheet or plate;

means positioned on either side of the roll mill having ducts and slotted air nozzles therein to direct hot air against the top, bottom and sides of the magnesium sheet or plate for heating the magnesium sheet or plate being rolled by the roll mill to a temperature below air temperature required to achieve a final gauge;

a mill drive system wherein the work rolls are independently driven for asymmetrical rolling of the magnesium sheet or plate;

external and internal work roll heaters;

at least one feed table and pinch roll; and a warm coil loading and payoff station.

19. The system of claim 18 wherein the means for heating the magnesium sheet or plate being rolled by the rolling mill is a hot coiler positioned on either side of the roll mill.

20. The system of claim 18 wherein the means for heating the magnesium sheet or plate is an active thermal roller table positioned on either side of the rolling mill.

* * * * *